US010442573B1

(12) United States Patent
Battat

(10) Patent No.: US 10,442,573 B1
(45) Date of Patent: Oct. 15, 2019

(54) COUPON CUP

(71) Applicant: Menashe Battat, Brooklyn, NY (US)

(72) Inventor: Menashe Battat, Brooklyn, NY (US)

( * ) Notice: Subject to any disclaimer, the term of this patent is extended or adjusted under 35 U.S.C. 154(b) by 0 days.

(21) Appl. No.: 16/141,443

(22) Filed: Sep. 25, 2018

(51) Int. Cl.
*B65C 3/10* (2006.01)
*B65D 25/20* (2006.01)
*B65D 3/10* (2006.01)
*B65D 3/04* (2006.01)

(52) U.S. Cl.
CPC ..... *B65D 25/205* (2013.01); *B65D 3/04* (2013.01); *B65D 3/10* (2013.01)

(58) Field of Classification Search
CPC ..... B65D 25/205; B65D 3/04; B65D 3/10; B65D 3/06; B65D 2203/00; B65D 1/265; B65D 81/3865
USPC .... 229/400, 4.5, 116.1, 5.5; 206/459.5, 217; 220/62.12, 592.17; D7/507; 40/324, 506
See application file for complete search history.

(56) References Cited

U.S. PATENT DOCUMENTS 2,113,715 A * 4/1938 Wilcox ..... B65D 3/10 206/232
3,557,987 A * 1/1971 Singer, Jr. ..... B65D 41/12 206/831
3,850,361 A * 11/1974 Day ..... B65D 1/265 206/232
4,171,085 A * 10/1979 Doty ..... B65D 3/28 206/459.5
4,518,639 A * 5/1985 Phillips ..... B65D 77/22 206/459.5
4,706,873 A * 11/1987 Schulz ..... B65D 3/06 206/459.5
5,007,578 A * 4/1991 Simone ..... B65D 3/28 206/459.5
5,076,433 A * 12/1991 Howes ..... B65D 25/205 206/217
5,996,887 A * 12/1999 Cai ..... B65D 3/06 206/831
6,032,820 A * 3/2000 Ladina ..... B65D 51/28 206/217
6,253,995 B1 * 7/2001 Blok ..... B65D 81/3869 229/198.2
6,308,883 B1 * 10/2001 Schmelzer ..... B29C 44/12 229/403
2005/0035187 A1 * 2/2005 Rea ..... B65D 3/06 229/400
2005/0184137 A1 * 8/2005 Dorsey ..... B65D 1/265 229/103
2005/0205437 A1 * 9/2005 Huffman ..... B65D 1/265 206/217
2006/0060479 A1 * 3/2006 Tedford, Jr. ..... B65D 25/205 206/217

(Continued)

*Primary Examiner* — Christopher R Demeree
(74) *Attorney, Agent, or Firm* — Stuart M. Goldstein

(57) ABSTRACT

A coupon cup has a circular outer cup wall with a bottom cup member attached. A space is created between the bottom cup member and the bottom rim of the cup into which a plurality of stacked coupons is placed. Each coupon is removably attached to an adjacent coupon by a fold connection, such that when the coupons are folded at these connections and stacked one on top of another, they form the single stack of coupons. A tab on one of the coupons allows the user to pull the coupons from the cup. This results in an extended accordion configuration of coupons which may thus be easily separated for use.

8 Claims, 4 Drawing Sheets

(56) References Cited

U.S. PATENT DOCUMENTS

| | | | | |
|---|---|---|---|---|
| 2007/0051790 | A1* | 3/2007 | Smith | B65D 3/06 229/400 |
| 2010/0200452 | A1* | 8/2010 | Solazzi | G09F 23/06 206/459.5 |
| 2010/0252555 | A1* | 10/2010 | Syed | B65D 3/06 220/212 |
| 2017/0057202 | A1* | 3/2017 | Ogren | B32B 7/12 |

* cited by examiner

COUPON CUP

BACKGROUND OF THE INVENTION

The use of printed advertisements, including the placement of printed coupons on the exterior of paper or cardboard cups is well known. However, especially as to coupons on the outside of cups, space is severely limited, and so the number of coupons which can be placed on a cup is limited as well. In addition, it is awkward to carry around a cup, which may be used and soiled, just to preserve a coupon. Cutting or tearing a coupon from the cup presents its own problems as it may be difficult to cleanly remove a small section of the cup.

SUMMARY OF THE INVENTION

It is thus the object of the present invention to provide a disposable cup which has the means to hold and secure a plurality of coupons which can easily and readily be removed from the cup without the need for cutting, tearing, or otherwise damaging the cup.

This and other objects of the present invention are accomplished by a disposable coupon cup having a circular outer cup wall with a bottom cup member attached. A space is created between the bottom cup member and the bottom rim of the cup into which a plurality of stacked coupons is placed. Each coupon is removably attached to an adjacent coupon by a fold connection, such that when the coupons are folded at these connections and stacked one on top of another, they form the single stack of coupons. A tab on one of the coupons allows the user to pull the coupons from the cup. This results in an extended accordion configuration of coupons which may then be easily separated for use.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
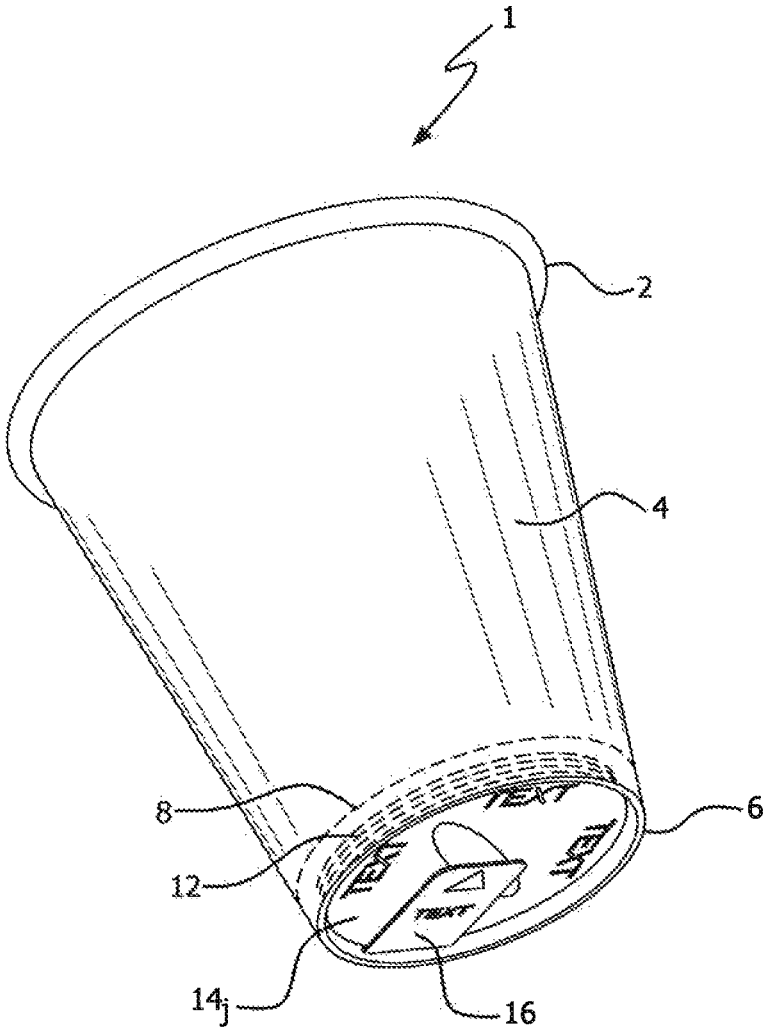
FIG. 1 is a perspective bottom view of the coupon cup of the present invention.

Coupon cup 1 of the present invention comprises cup member 2 having circumferential outer cup wall 4 with bottom rim 6. Bottom cup member 8 is attached to cup wall 4 and inset from bottom rim 6 to form open space 10.

Coupon string 14 comprises a plurality of coupons 14*a*-14*j*, each coupon being attached to its adjacent coupon by a fold connection. Coupon tab 16 is attached, also by a foldable connection, to the outermost coupon 14*j*.

In their first or stored position, coupons 14*a*-14*j* of coupon string 14 are folded up and stacked, one on top of each of their respective adjacent coupons, to form a stack of coupons 12, the coupon stack being positioned within space 10, between bottom cup member 8 and bottom rim 6. See FIG. 1. The coupons of coupon stack 12 is sized to be pressure fitted and thus held tightly within space 10.

Figure 2:
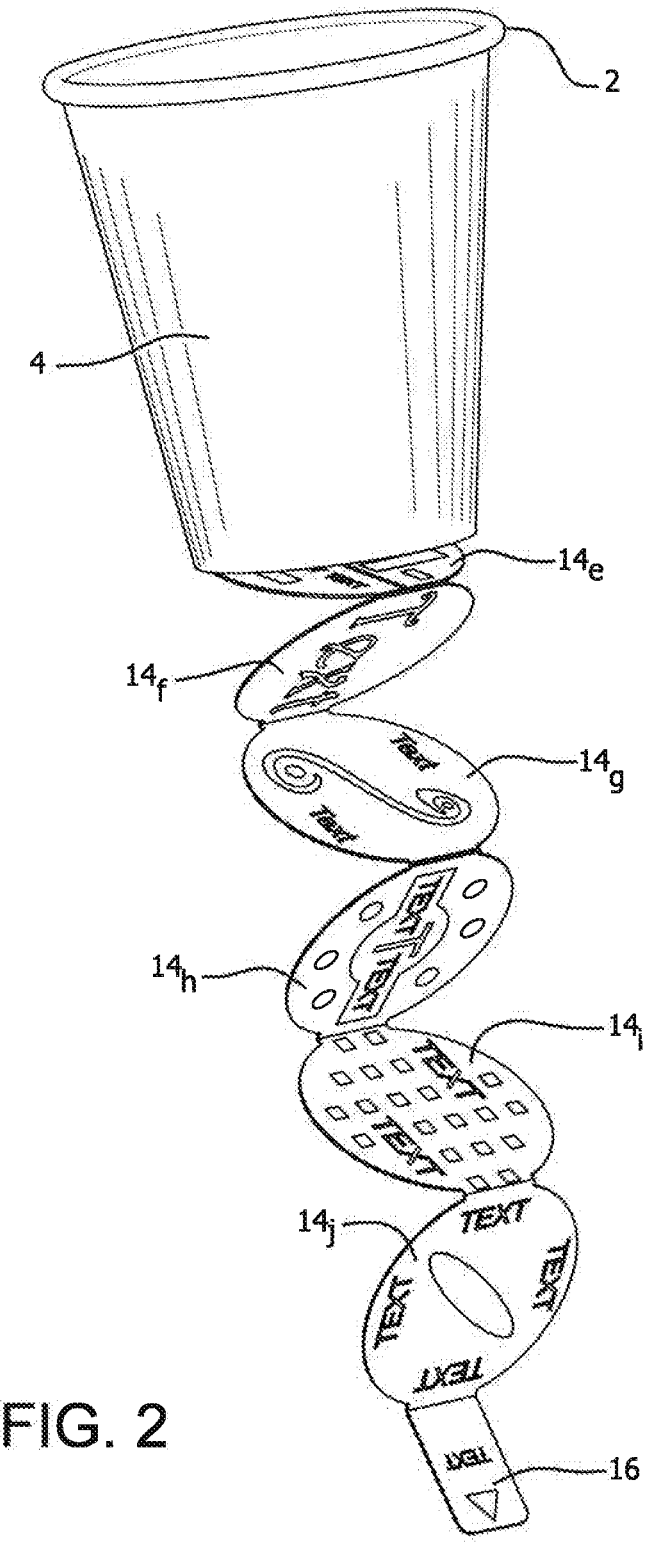
FIG. 2 is a view of the coupon cup of the present invention with its coupons partially extended from the bottom of the cup.
Figure 3:
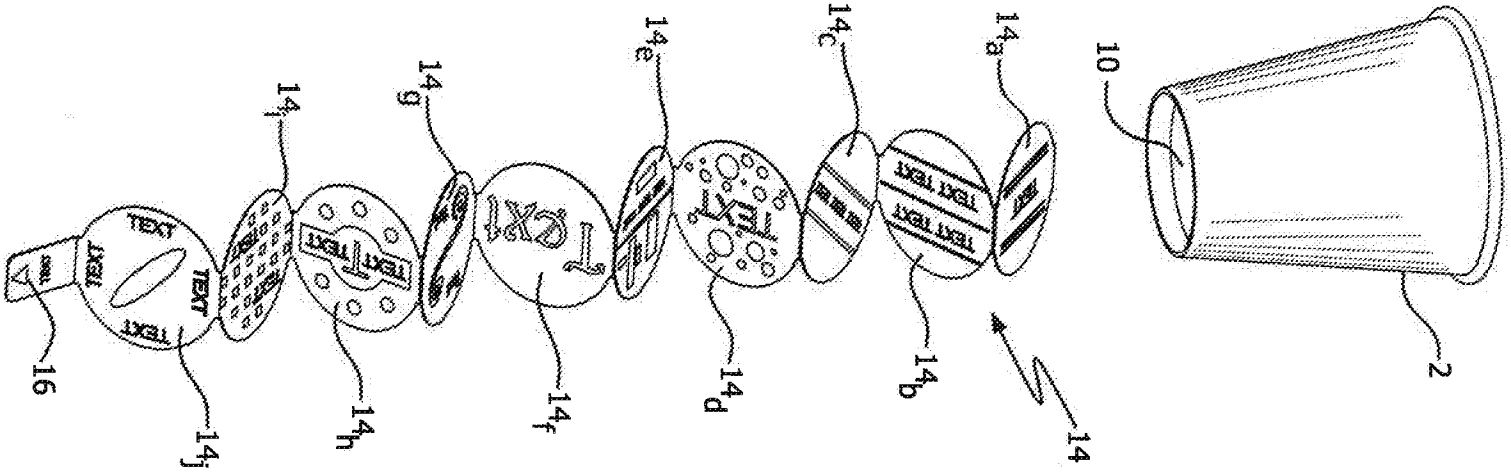
FIG. 3 is a view of the coupon cup of the present invention with its coupons completely separated from its cup.
Figure 4:
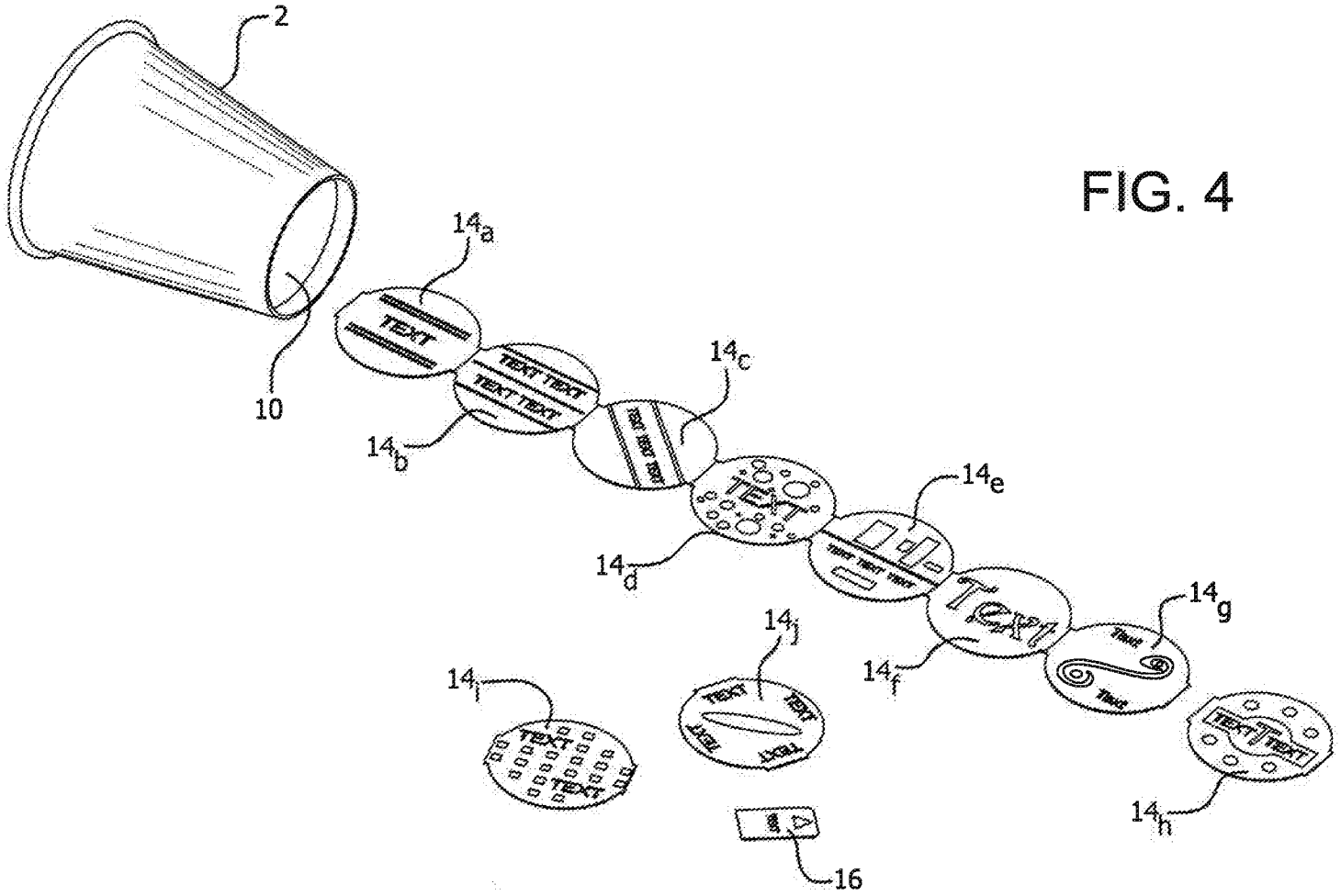
FIG. 4 illustrates the manner of using coupons removed from the coupon cup of the present invention.

To utilize coupons 14*a*-14*j*, they must be removed from cup 1. To accomplish this, tab 16 is pulled outward. This results in all the coupons in coupon string 14 being pulled out from space 10 in a second position, i.e. an extended, accordion-like configuration. See FIGS. 2 and 3. Individual coupons can then be torn off coupon string 14 for use. See FIG. 4.

Once the coupons in coupon string 14 are removed, the remaining coupons can be refolded into a stack and, again, since the coupons are so sized, they can be pressure-fitted back into space 10 if desired.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A coupon cup comprising:

a circular outer cup wall having a top rim and a bottom rim;

a cup bottom member attached to the cup wall, inset from the bottom rim such that a space is created between the bottom member and the bottom rim;

a plurality of coupons, each coupon of the plurality of coupons being removably attached to an adjacent coupon by a fold connection, whereby in a first position the coupons are folded at this fold connection such that one coupon is positioned on top of an adjacent coupon to form a single stack of coupons, the stack being located in said space between the bottom member and the rim member, and in a second position, the coupons are extended in accordion-like configuration to form a line of coupons which are configured to be removed from the space; and a tab attached to one of the plurality of coupons.

2. A coupon cup as in claim 1 wherein in the first position, the stack of coupons is pressure-fitted in the space between the bottom wall the bottom rim of the cup.

3. The coupon cup as in claim 2 wherein in the second position the extended line of coupons are removable from the space and are configured to be again foldable into a stack and reinserted and positioned within the space.

4. The coupon cup as in claim 1 wherein each coupon can be separated from its adjacent coupon at the fold connection between each coupon.

5. A coupon cup comprising:

a circular outer cup wall having a top rim and a bottom rim;

a cup bottom member attached to the cup wall, inset from the bottom rim such that a space is created between the bottom member and the bottom rim;

a plurality of coupons, each coupon of the plurality of coupons being removably attached to an adjacent coupon by a fold connection, whereby the coupons are folded at this fold connection such that one coupon is positioned on top of an adjacent coupon to form a single stack of coupons, the stack being located in said space between the bottom member and the rim member; and a tab attached to one of the plurality of coupons.

6. A coupon cup as in claim 5 wherein in the stack of coupons is pressure-fitted in the space between the bottom wall the bottom rim of the cup.

7. The coupon cup as in claim 5 wherein in the stack of coupons are removable from the space and are configured to be reinserted and positioned within the space.

8. The coupon cup as in claim 5 wherein each coupon can be separated from its adjacent coupon at the fold connection between each coupon.

* * * * *